US008474205B1

(12) United States Patent
Watkins

(10) Patent No.: US 8,474,205 B1
(45) Date of Patent: Jul. 2, 2013

(54) CONCRETE FOUNDATION FOOTING WITH TIMBER SUPPORT MEMBERS

(76) Inventor: William R. Watkins, Grapevine, TX (US)

( * ) Notice: Subject to any disclaimer, the term of this patent is extended or adjusted under 35 U.S.C. 154(b) by 136 days.

(21) Appl. No.: 13/291,690

(22) Filed: Nov. 8, 2011

(51) Int. Cl.

| | |
|---|---|
| ***E04B 1/00*** | (2006.01) |
| ***E04B 5/00*** | (2006.01) |
| ***E04B 7/00*** | (2006.01) |
| ***E02D 27/00*** | (2006.01) |
| ***E02D 27/32*** | (2006.01) |

(52) U.S. Cl.
USPC ..... 52/292; 52/284

(58) Field of Classification Search
USPC ..... 52/233, 274, 292–299; 403/229
See application file for complete search history.

(56) References Cited

U.S. PATENT DOCUMENTS

| | | | | |
|---|---|---|---|---|
| 3,435,567 | A | 4/1969 | Tyson | |
| 3,722,225 | A | 3/1973 | Empson | |
| 4,275,538 | A | 6/1981 | Bounds | |
| 4,563,852 | A * | 1/1986 | Achtenberg et al. | 52/742.14 |
| 4,608,794 | A | 9/1986 | Delise | |
| 4,627,205 | A * | 12/1986 | Hitchins | 52/294 |
| 4,706,428 | A * | 11/1987 | McCoy et al. | 52/293.2 |
| 4,903,450 | A | 2/1990 | Adams | |
| 4,910,076 | A | 3/1990 | Ando et al. | |
| 4,916,874 | A * | 4/1990 | McCoy et al. | 52/293.2 |
| 5,283,994 | A | 2/1994 | Callison | |
| 5,419,649 | A | 5/1995 | Gilb | |
| 5,440,845 | A | 8/1995 | Tadros et al. | |
| 5,481,836 | A * | 1/1996 | Miller et al. | 52/127.2 |
| 5,542,787 | A | 8/1996 | Charlanow | |
| 5,829,220 | A * | 11/1998 | Zumeta | 52/741.13 |
| 6,033,150 | A * | 3/2000 | Culen | 405/216 |
| 6,526,721 | B1 * | 3/2003 | Nash | 52/677 |
| 7,076,925 | B2 * | 7/2006 | Gagliano | 52/155 |
| 7,506,859 | B2 * | 3/2009 | Keller et al. | 256/65.14 |
| 7,578,105 | B2 | 8/2009 | Eberle, III | |
| 7,744,315 | B2 * | 6/2010 | Kim et al. | 405/229 |
| 2005/0086906 | A1 | 4/2005 | Bathon et al. | |
| 2007/0175163 | A1 | 8/2007 | Williams et al. | |
| 2009/0190996 | A1 | 7/2009 | Clarke | |
| 2009/0199497 | A1 | 8/2009 | Wrightman | |

* cited by examiner

*Primary Examiner* — Andrew Triggs
(74) *Attorney, Agent, or Firm* — Mark W Handley

(57) ABSTRACT

A foundation footing (30) has a support framework (32) encased within concrete (38). The support framework (32) includes elongate members (34) formed of timber, such as telephone poles, which extend the full length of the footing (30). Brackets (36) rigidly securing terminal ends (42) and intermediate portions (44) of the elongate members (34) in fixed relation. The brackets (36) have steel plates (46) disposed beneath the elongate members (34) and binding chains (48) secured to the steel plates (46). The binding chains (48) are preferably loosely secured around the elongate members (34) until being encased within the concrete (38), which rigidly secures the binding chains (48) to the elongate members (34) and the elongate members (34) to the steel plates (46). Grooves (86) are formed into the elongate members (34) to increase the bonding between the elongate members (34) and the concrete (38).

18 Claims, 7 Drawing Sheets

FIG. 15
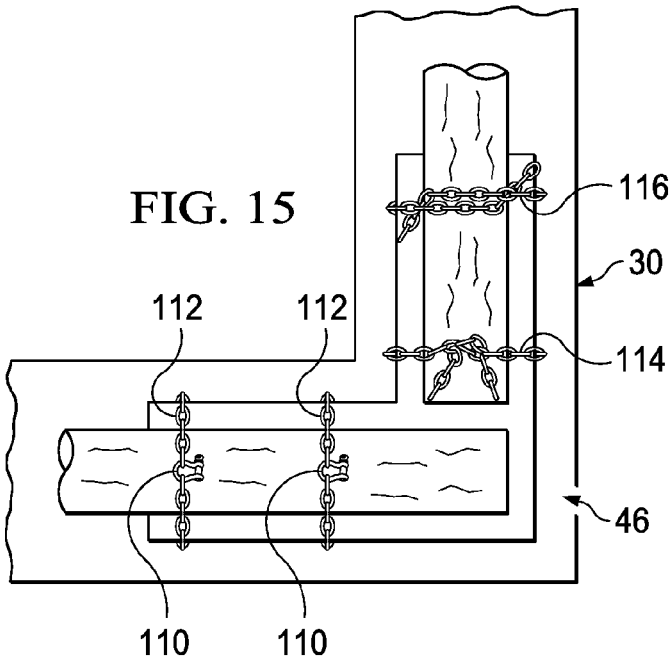
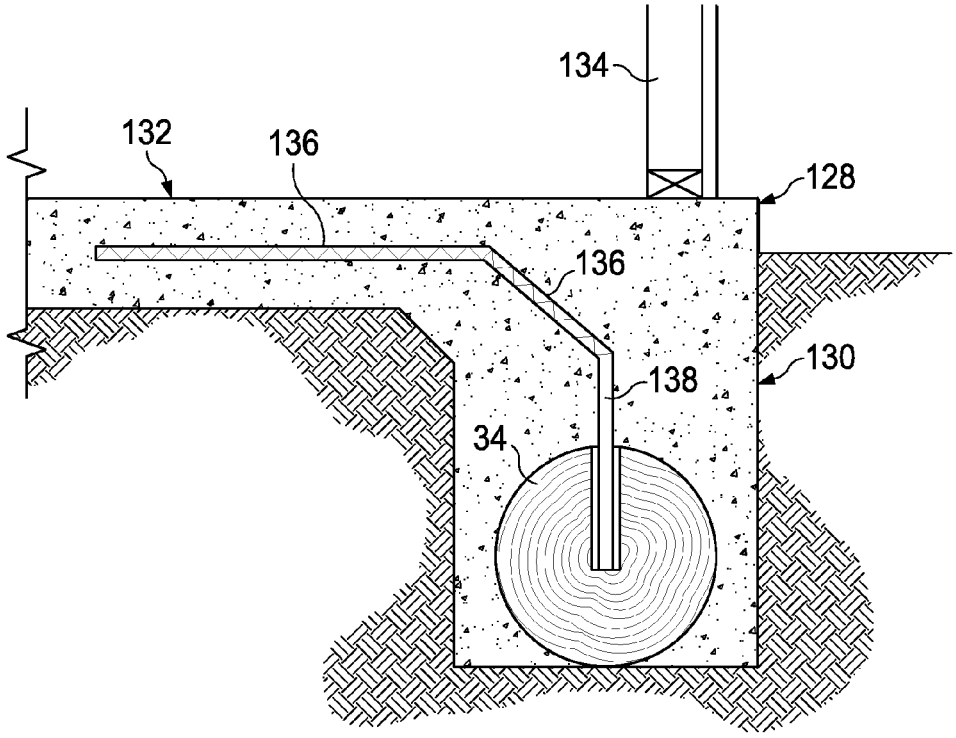
FIG. 16

CONCRETE FOUNDATION FOOTING WITH TIMBER SUPPORT MEMBERS

TECHNICAL FIELD OF THE INVENTION

The present invention relates in general to building foundations, and in particular to a building foundation footing made of concrete.

BACKGROUND OF THE INVENTION

Prior art foundation footings have been provided by concrete forms used to support foundations. A foundation footing is typically uniformly supported by the ground. Various environmental factors may cause the soil beneath a foundation footing to no longer support portions of a foundation footing. This may occur when the sun dries moisture from clay soils, during droughts, and when vegetation or trees remove water from the soil beneath the foundation footings. Erosion from water runoff may also remove soil from beneath foundation footings. Void spaces created beneath a foundation footing often result in structural damage to the foundation footing when stresses place the concrete in tension or result in stresses which exceed the strength of the foundation footing.

SUMMARY OF THE INVENTION

A foundation footing is provided with a continuous support framework encased within concrete. The framework includes elongate members which are preferably provided by timbers, such as telephone poles. The elongate members extend continuously around a perimeter of the foundation, encased within the concrete. Brackets secure ends and intermediate portions of the elongate members together in a rigid, fixed relation such as to provide structural support for the foundation footing. The brackets preferably have steel plates above which the elongate members are placed and binding chains which wrap around the terminal end and respective intermediate portions of the elongate timber members. The foundation footing preferably will have porous fill materials, such as crushed stone, lining the bottom of a trench in which the foundation footing is formed. A moisture barrier is preferably laid atop the porous fill material, with the brackets sitting atop the moisture barrier. Concrete fills the voids in the trench, providing a concrete encasement within which the brackets, the elongate members, and the binding chains are rigidly secured in fixed relation.

DESCRIPTION OF THE DRAWINGS

For a more complete understanding of the present invention and the advantages thereof, reference is now made to the following description taken in conjunction with the accompanying Drawings in which FIGS. 1 through 16 show various aspects for concrete foundation footing with timber support members devices made according to the present invention, as set forth below:

FIG. 1 is a perspective view of a building having a prior art foundation footing;

FIG. 2 is a top view of a trench with the support framework for forming a foundation footing according to the present invention;

FIG. 3 is a top view of an L-shaped bracket for joining the ends of two timbers of the foundation footing;

FIG. 4 is a top view of a T-shaped bracket for joining the ends of two or more timbers;

FIG. 5 is a top view of an I-shaped bracket for joining the ends of two timbers aligned in lineal relation;

FIG. 6 is an end view of a bracket formed of a C-shaped channel and a flat steel plate;

FIG. 7 is a top view of an L-shaped bracket formed with a C-shaped channel and a steel plate;

FIG. 8 is a side elevation view of a bracket formed of angle iron members and a flat plate;

FIG. 9 is a top view of an L-shaped bracket formed of the angle iron members and the flat plate of FIG. 8;

FIG. 10 is a top view of an L-shaped bracket having spaced apart protuberant tabs mounted to a flat steel plate for supporting a timber above the bracket;

FIG. 11 is a top view of various components for a footing prior to encasing within concrete;

FIG. 12 is a section view taken along section line 12-12 of FIG. 11, showing the footing after encasing the various components in concrete;

FIG. 13 is a side elevation view showing a vertical section of a foundation footing having a connecting rod;

FIG. 14 is a side elevation view of a vertical section of a foundation footing having ground pins non-rotatably securing a timber within a trench prior to encasing the timber in concrete;

FIG. 15 is a top view of a corner of a foundation footing showing various arrangements for securing timbers atop bracket plates using chains; and FIG. 16 is a vertical section view of a foundation having a foundation footing.

DETAILED DESCRIPTION OF THE INVENTION

Figure 1:
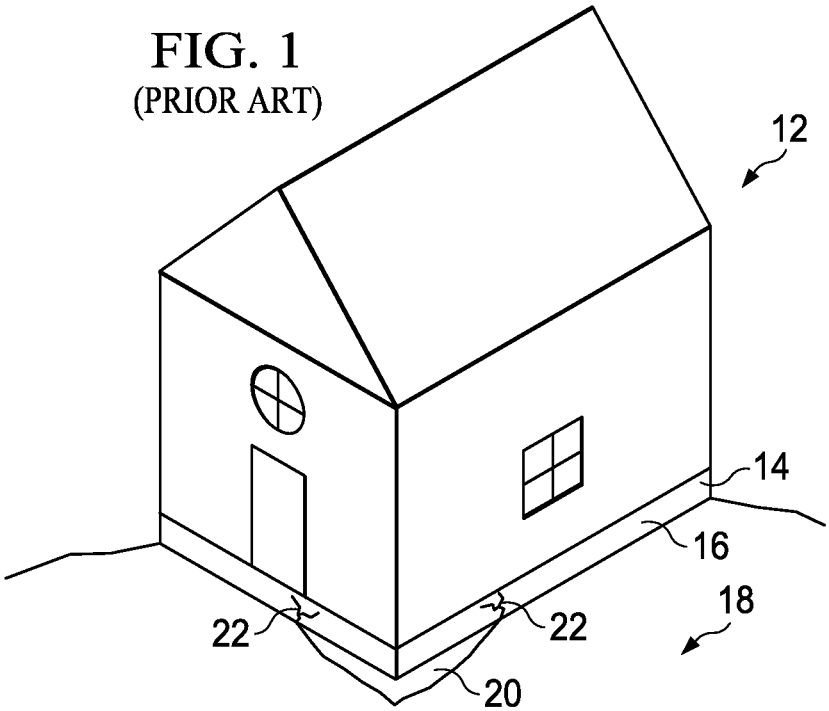
FIG. 1 (PRIOR ART)

FIG. 1 is a perspective view of a building 12 having a foundation 14 with a prior art foundation footing 16. The prior art foundation footing 16 is initially uniformly supported by the ground 18. However, over time, the sun may dry clays in the soil of the ground 12, or vegetation may also remove moisture from soil causing voids 20 to occur in the ground 18 underneath the footing 16. Concrete used to form foundations is typically strong in compression but not in tension, and voids 20 cause the weight of the building 12 and the foundation 14 to cause stresses in the foundation footing 16 which causes structural damage 22.

Figure 2:
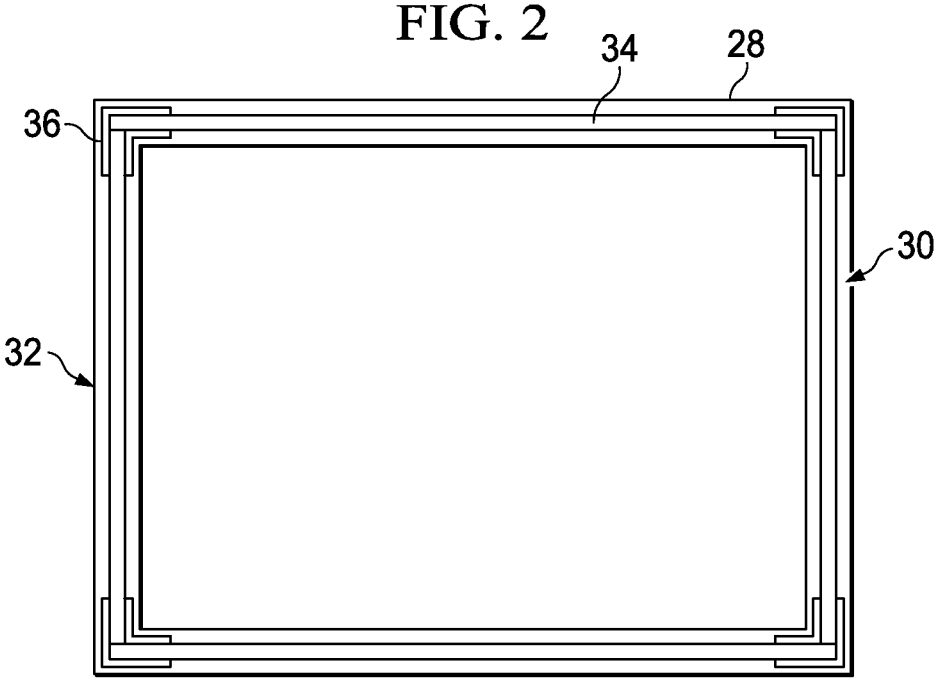

FIG. 2 is a top view of a trench 28 with the support framework 32 for forming a foundation footing 30 according to the present invention. The foundation footing 30 as shown will be formed within the trench 28 formed into the earth. The foundation footing 30 has four lengths, each length extending along the four sides of the footing 30. Elongate members 34, preferably provided by wooden timbers, such as telephone poles, extend fully within the longitudinal lengths of each section of the trench 28, with the members 34 having lengths which extend parallel to and coaxially with the lengths of the footing 30. Ends of the elongate members 34 are fixedly secured in rigid relation to adjacent members 34 by brackets 36. The trench 28 will be filled with concrete 38 (shown in FIG. 12) to encase the elongate members 34 and the brackets 36 in the concrete foundation footing 30.

Figure 3:
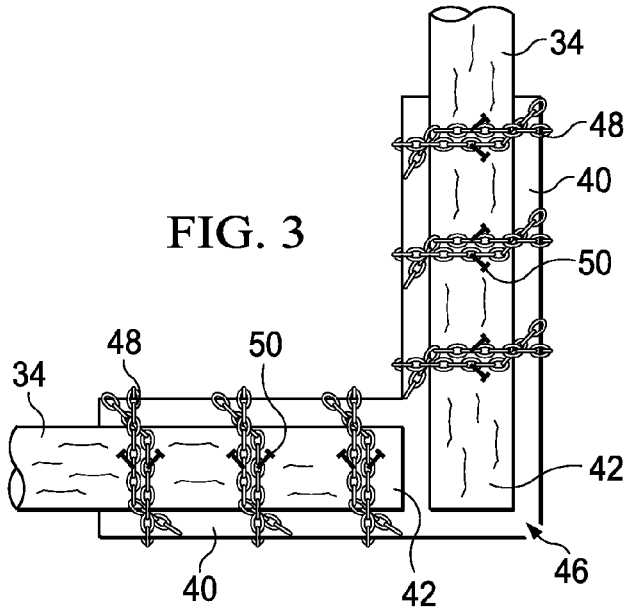

FIG. 3 is a top view of an L-shaped bracket 46 which may be used for the bracket 36 of FIG. 2 to join the ends of two elongate members 34 of the foundation footing 30 at right angles. The L-shaped bracket 46 is preferably provided by two one-quarter inch thick steel plates 40 which are welded together, with each plate 40 being approximately twelve inches wide by twenty-four inches long. Binding members 34 are provided by steel chains which are approximately sixty inches long and are welded to the bottom of the steel plates 40.

Terminal ends 42 of the elongate members 34 are aligned adjacent to one another atop respective ones of the steel plates 40, with the terminal end 42 of a first elongate member 34 aligned adjacent of a side 44 of the terminal end 42 of the other of the elongate members 34. The binding members 48 are secured about the elongate members 34 to rigidly secure the terminal ends 42 of the elongate members 34 in centrally disposed positions above respective ones of the plates 40 of the L-shaped bracket 46. Fasteners 50, preferably provided by nails or spikes, are driven through links of the binding members 48 and into the elongate members 34 to secure the binding members 48 about the elongate members 34. Preferably the binding members 38 are loosely around the top sides of each of the elongate members 34 until the concrete 38 for the foundation footing 30 is set, which then encases the binding members 48 in fixed positions adjacent to the elongate members 34 and the L-shaped bracket 46. The spaces between the links of the steel chains, which provide the binding member 34 of the preferred embodiment, will be filled with concrete 38, such that they will not move after the concrete 38 sets up.

Figure 4:
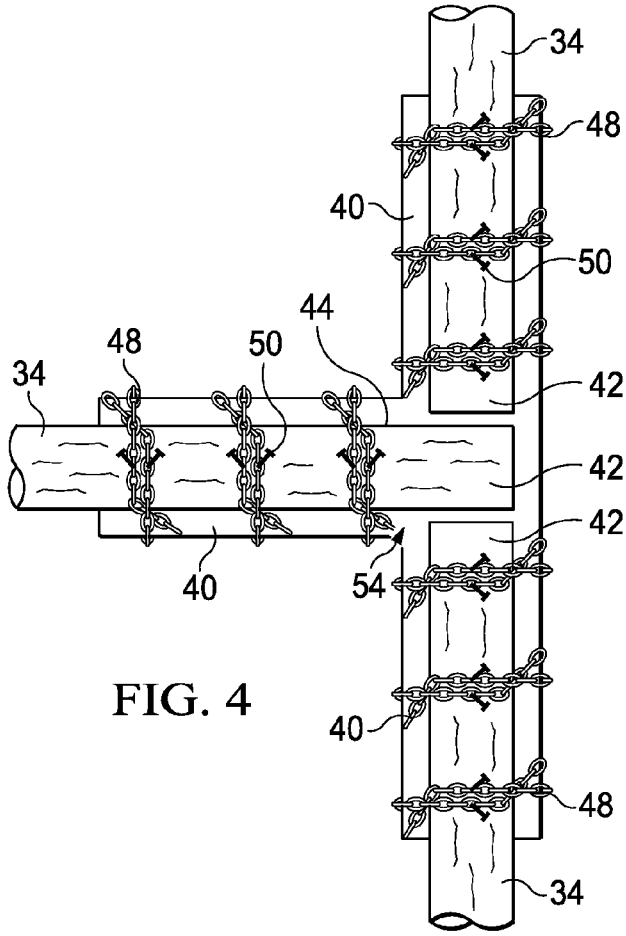

FIG. 4 is a top view of a T-shaped bracket 54 which joins the terminal ends 42 of two or more timber members 34 in fixed relation. The T-shaped bracket 54 is preferably provided by three one-quarter inch thick steel plates 40 which are welded together, with two of the plates 40 configured end-to-end and one plate being at a ninety degree angle to the other two plates 40. Each of the plates 40 are approximately twelve inches wide by twenty-four inches long. The binding members 48 are provided by steel chains which are approximately sixty inches long and are welded to the bottom of the steel plates 40. The binding chains 48 secure two or three elongate timber members 34 to the T-shaped bracket 54. In one configuration, the T-shaped bracket 54 will secure three terminal ends 42 of elongate members 34 together, with two of the elongate members 34 mounted with terminal ends 42 butted together such that terminal end faces together in opposed relation, and the third of the elongate members 34 having a terminal end face butted against the sides of the two terminal ends 42 which are butted together. In a second configuration, two elongate members 34 are joined together rather than three elongate members 34, a first elongate members 34 extends lineally across the two of the butted plates 40 the T-shaped bracket 54 rather than the two of the elongate members 34 which are butted together with end faces disposed adjacent to one another, in opposed relation. A second of the elongate members 34 will have a terminal end face butted against a side of the first elongate members.

Figure 5:
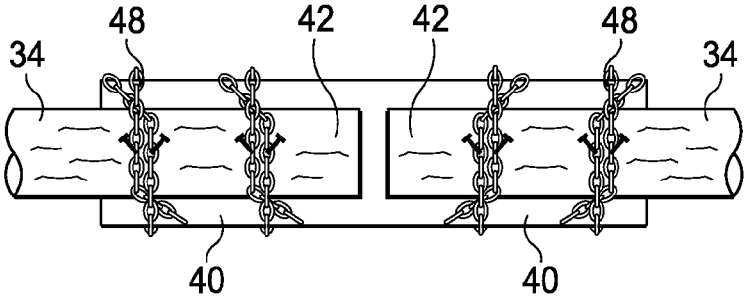

FIG. 5 is a top view of an I-shaped bracket 56 for joining the ends of two timbers aligned in lineal relation. The I-shaped bracket 56 is provided by two of the one-quarter inch thick steel plates 40 which are each approximately twelve inches wide by twenty-four inches long. The two plates 40 are butted together end-to-end and are welded together. The binding members 48 are provided by steel chains which are approximately sixty inches long and are welded to the bottom of the steel plates 40. The binding chains 48 secure two of the elongate members 34 to the I-shaped bracket 56, with longitudinal axes of the two members 34 in coaxial alignment and end faces of the terminal ends 42 disposed in an adjacent, opposed relation.

Figure 6:
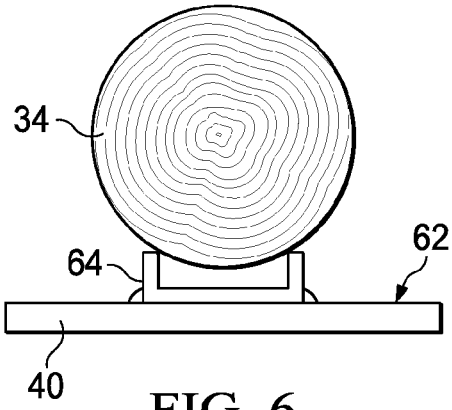
Figure 7:
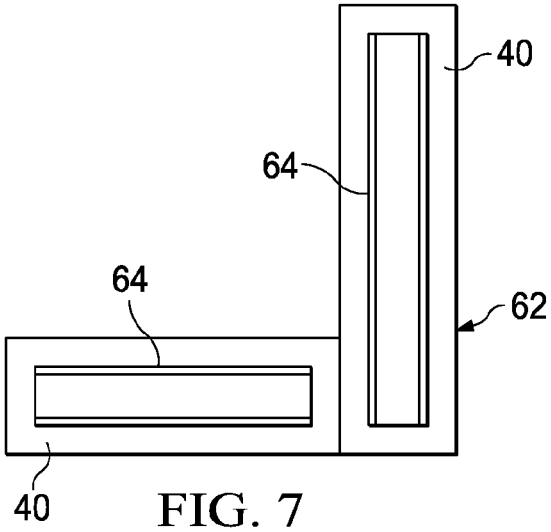

FIG. 6 is an end view and FIG. 7 is a top view of an L-shaped bracket 62 formed of C-shaped channels 64 welded to the top of two of the flat steel plates 40. The longitudinal length of the C-shaped channel 64 extends parallel to and centrally aligned with the longitudinal length of the plate 40. The bracket plate 62 is preferably provided by two of the one-quarter inch thick steel plates which are welded together at a right angle, with each of the plates being approximately twelve inches wide by twenty-four inches long. The C-channel 64 extends with the opening upright, and the web-portion connecting the opposed flanges mounted flat against the top of the flat steel plates 40. Elongate timber members 34 will fit within the opening in the C-channel 64 to locate a central longitudinal axis the timber members 34 to extend parallel to the lengths of respective ones of the C-channels 64. Preferably the binding chains 48 (now shown) are welded to the L-shaped bracket 62 for securing the two elongate members 34 to the L-shaped bracket 62.

Figure 8:
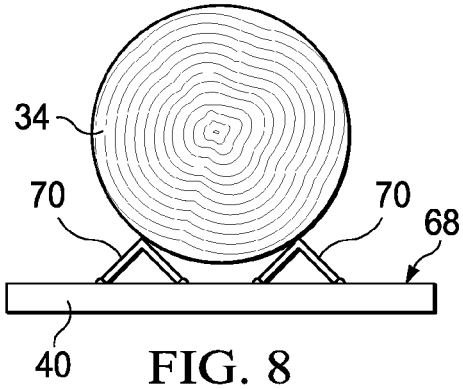
Figure 9:
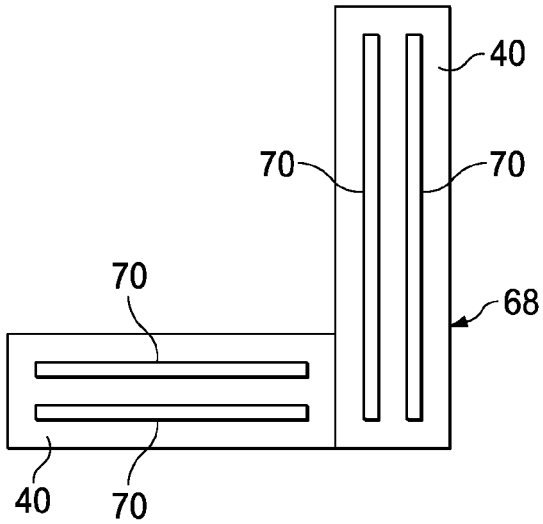

FIG. 8 is a side elevation view and FIG. 9 is a top view of an L-shaped bracket 68 formed of four spaced apart, elongate angle iron members 70 and two of the steel plates 40. The steel plates 40 are preferably one-quarter inch thick and measure approximately twelve inches wide by twenty-four inches long. The two plates 40 are welded together at right angles. The elongate angle iron members 70 are preferably welded in spaced apart relation atop respective ones of the plates 40, with longitudinal lengths of the angle iron members 70 extending in parallel and parallel the longitudinal lengths of the respective ones of the two steel plates 40 to which they are mounted. The angle iron members 70 are mounted with the V-shaped junction of the sides of the angle iron members 70 facing upward, in a direction opposite to the steel plates 40. Two elongate members 34 will be mounted to the bracket 68, at right angles to one another. The elongate members 34 will mounted above the two angle iron members 70, each fitting into the space between the angle iron members 70 as show in FIG. 8. Preferably the binding chains 48 (now shown) are welded to the L-shaped bracket 68 for securing the two elongate members 34 to the L-shaped bracket 68.

Figure 10:
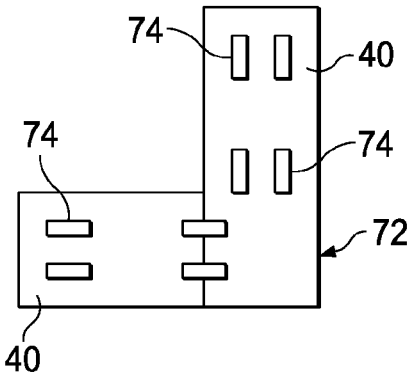

FIG. 10 is a top view of an L-shaped bracket 78 formed of two of the steel plates 40 joined at right angles, with protuberant tabs 74 mounted to the faces of the steel plates 40 for extending upward to support elongate members 40. Eight of the tabs 74 are shown, with four disposed on each of the plates 40. Two of the tabs 74 are spaced apart along the length of each of the plates 40, and are spaced apart on opposite sides of the plate from two other tabs 74, which are also spaced apart from one another along the lengths of the plate 40. The spacing of the protuberant tabs 74 provides support to locate an elongate member 34 above the corresponding steel plate 40. Two of the elongate members 40 are joined together at right angles when mounted to the L-shaped bracket 78. Preferably the binding chains 48 (now shown) are welded to the L-shaped bracket 78 for securing the two elongate members 34 to the L-shaped bracket 78.

Figure 11:
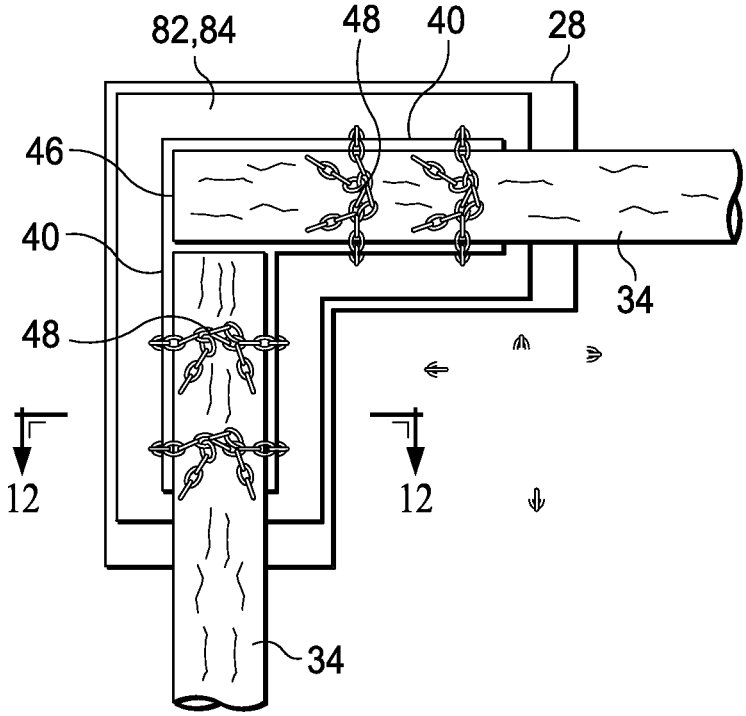
Figure 12:
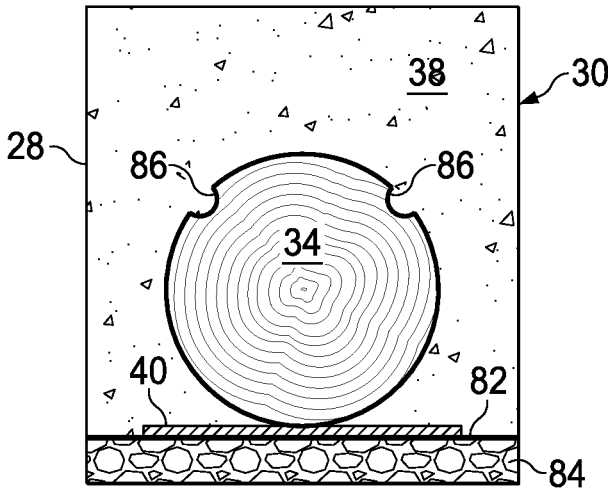

FIG. 11 is top view of various components for a footing prior to encasing within concrete 38, and FIG. 12 is a section view taken along section line 12-12 of FIG. 11 and shows the foundation footing 30 after encasing the various components in the concrete encasement 38. The foundation footing 30 has elongate timber members 34 encased within the concrete 38. A permeable bedding 84 is preferably provided by crushed stone located at the bottom of a channel defining a trench 28. An impervious liner 82 extends above the bedding 84 to provide a moisture barrier. The liner 82 may be provided by conventional materials, such as a plastic sheeting of polypropylene, or the like. The liner 82 may also be provided by a binder poured atop the bedding 84 which cures to seal an upper portion of the bedding 84. A steel plate 40 of an L-shaped bracket 80 is located atop the liner 82, and the elongate timber member 34 is preferably centered on top of the bracket plate 40. Two grooves 86 are shown providing elongate channels formed into the timber member 34 to increase the surface area of the member 34 to improve bonding of the concrete 38 to the member 34. Additionally the two grooves 86 provide surface non-conformities which result in increased structural surface roughness to provide voids for filling with concrete to increase the mechanical bond between the timber members 34 and the concrete 38.

Figure 13:
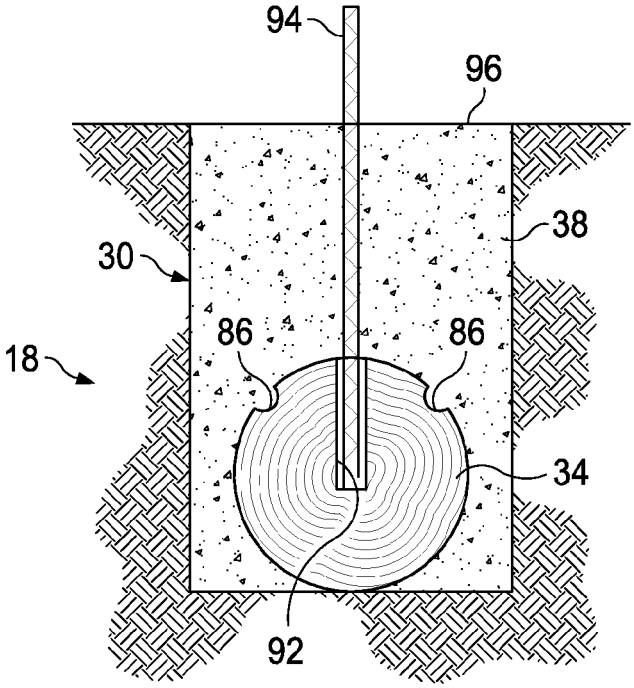

FIG. 13 is a side elevation view showing a vertical section of the foundation footing 30 having a connecting rod 94. The connecting rod 94 is preferably provided by steel rebar, such as a No. 4, No. 5 or No. 6 steel rebar, ranging in length from twelve inches, to twenty-four inches, to thirty-six inches long. The terminal end of the steel rebar connecting rods 94 may extend above the upper surface 96 of the foundation footing 30, and may be welded directly to steel rebar used in a concrete slab poured on top of the foundation footing 30. The connecting rod may also be joined to structural members in a wall located above the foundation footing 30.

Figure 14:
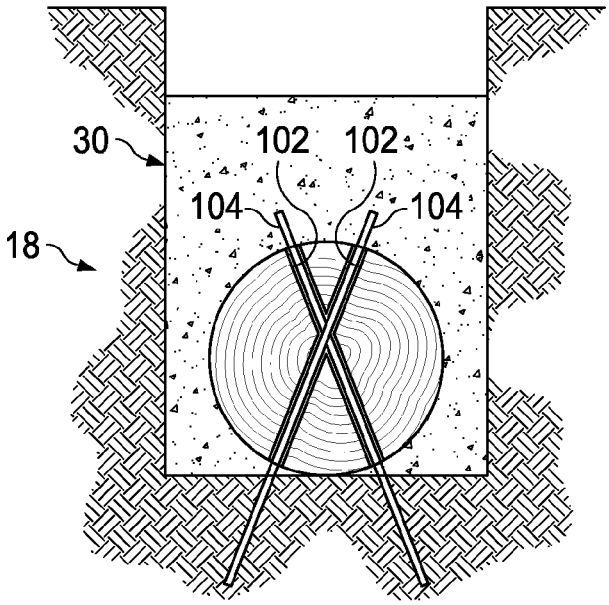

FIG. 14 is a side elevation view of a vertical section of the foundation footing having ground pins 104 non-rotatably securing a timber within a trench 28 prior to encasing the timber 34 in concrete 38. Apertures 102 are preferably through-holes extending through the elongate timber member 34 at twenty-two degrees to the vertical. The apertures 102 are sized for receiving the ground pins 104.

FIG. 15 is a top view of a corner of the foundation footing 30 showing various arrangements for securing elongate support members 34 atop the L-shaped bracket 46 with binding members 48. The binding members 48 are preferably sixty inch long steel link-type chains which are welded to the bottom of the plates 40 of the L-shaped bracket 46. Two of the binding members 40 are labeled as binding chains 112 and shown wrapped over the elongate member 34, from one side to the other, with each of the ends secured directly to the L-shaped bracket 46 by clevis fasteners 110. A second of the binding members 40 is labeled as a binding chain 114 and has terminal ends of the chain 114 twisted together above the tope of the elongate member 34. A third of the binding members is labeled as a binding chain 116 which has opposite terminal ends 118 twisted around the body of the binding chain 116 spaced apart on opposite sides of the elongate member 34.

FIG. 16 is a vertical section view of a foundation 128 with a foundation footing 130 made according to the present invention. The foundation 128 also includes a concrete slab 132 and a wall 134 mounted atop the footing 130. Steel rebar 136 extends in the concrete slab 132 and has an end portion which defines a connecting rod end 138. Preferably the connecting rod end 138 and the steel rebar 136 are one continuous member, and the connecting rod end 138 fits in the opening 92 in the elongate timber member 34. Preferably the opening 92 is a blind hole.

The present invention provides a concrete foundation footing with elongate members formed of timber, preferably telephone poles, encased within the concrete footing to provide a structural support framework. Terminal ends of the elongate members are fixedly bound by binding chains to steel plates to rigidly secure the terminal ends to adjacent elongate members. The elongate members, the binding chains, and the steel plates are encased within the concrete footing. Grooves provide channels on the outer surfaces of the elongate members to increase the surface area of the elongate members and improve bonding between the concrete encasement and the elongate members. Holes are formed into the elongate members for receiving connecting rods which extend upward from the concrete footings and above the surface of the footing. Ground pins extend downward from within the elongate members and into the ground to disposed the elongate members in fixed relation to the ground prior to being encased within concrete.

Although the preferred embodiment has been described in detail, it should be understood that various changes, substitutions and alterations can be made therein without departing from the spirit and scope of the invention as defined by the appended claims.

What is claimed is:

1. A foundation footing comprising:

an encasement extending about a perimeter of a foundation, said encasement having lengths and extending longitudinally along said lengths;

a support framework encased within said encasement, said support framework including elongate members formed of timber which extend within said encasement, wherein said elongate members include terminal ends and intermediate portions extending between said terminal ends parallel to respective ones of said lengths of said encasement;

brackets respectively secured in fixed relation to adjacent ones of at least two of said terminal ends and said intermediate portions of respective ones of said elongate members, rigidly securing said elongate members in fixed relation encased within said encasement; and said brackets including plates disposed beneath said elongate members and binding members secured around respective ones of said terminals ends and intermediate portions of said elongate members.

2. The foundation footing according to claim 1, wherein said binding members are steel chains which are loosely secured to said elongate members prior to encasing said elongate members, and said steel chains are rigidly secured to said elongate members by means of said encasement.

3. The foundation footing according to claim 2, wherein said steel chains are loosely secured to said elongate members by wrapping said steel chains about at least one side of said elongate members, twisting ends of said steel chains together, and securing said ends of said steel chains in fixed relation to respective ones of said elongate members by means of fasteners.

4. The foundation footing according to claim 1, further comprising holes formed into an upper surface of said elongate members for receiving connecting rods, and said connecting rods disposed within said holes for extending outward from said encasement in an upward direction.

5. The foundation footing according to claim 1, further comprising apertures formed into said elongate members for receiving ground pins, and said ground pins which extend from within said elongate members into the ground and preventing rotation of said elongate members.

6. The foundation footing according to claim 1, wherein peripheries of said elongate members have grooves formed therein to define channels for receiving said encasement.

7. A foundation footing comprising:

a concrete encasement extending about a perimeter of a foundation, said concrete encasement having lengths and extending longitudinally along said lengths;

a support framework encased within said concrete encasement, said support framework including elongate members formed of timber which extend within said concrete encasement, wherein said elongate members formed of timber include terminal ends and intermediate portions extending between said terminal ends parallel to respective ones of said lengths of said concrete encasement; and brackets respectively secured in fixed relation to adjacent ones of at least two of said terminal ends and said intermediate portions of respective ones of said elongate members formed of timber, rigidly securing said elongate members in fixed relation encased within said concrete encasement.

8. The foundation footing according to claim 7, further comprising said brackets including plates disposed beneath said elongate members and binding chains secured around respective ones of said terminals ends and intermediate portions of said elongate members.

9. The foundation footing according to claim 8, wherein said binding chains are loosely secured to said elongate members prior to encasing said elongate members, and said binding chains are rigidly secured to said elongate members by means of said concrete encasement.

10. The foundation footing according to claim 9, wherein said binding chains are loosely secured to said elongate members by wrapping said binding chains about at least one side of said elongate members, twisting ends of said binding chains together, and securing said ends of said binding chains in fixed relation to respective ones of said elongate members by means of fasteners.

11. The foundation footing according to claim 8, further comprising holes formed into an upper surface of said elongate members for receiving connecting rods, and said connecting rods disposed within said holes for extending outward from said encasement in an upward direction.

12. The foundation footing according to claim 8, further comprising apertures formed into said elongate members for receiving ground pins, and said ground pins which extend from within said elongate members into the ground and preventing rotation of said elongate members.

13. The foundation footing according to claim 8, wherein said elongate members formed of timber have grooves formed into peripheries thereof to increase a surface area of said peripheries and increase binding of said elongate members to said concrete encasement.

14. A concrete foundation footing comprising:

a concrete encasement extending about a perimeter of a foundation, said concrete encasement having lengths and extending longitudinally along said lengths;

a support framework encased within said concrete encasement, said support framework including elongate members formed of timber which extend within said concrete encasement, wherein said elongate members formed include terminal ends and intermediate portions extending between said terminal ends parallel to respective ones of said lengths of said concrete encasement;

brackets respectively secured in fixed relation to adjacent ones of at least two of said terminal ends and said intermediate portions of respective ones of said elongate members, rigidly securing said elongate members in fixed relation encased within said concrete encasement;

said brackets including plates disposed beneath said elongate members and binding chains secured around respective ones of said terminals ends and intermediate portions of said elongate members; and wherein said elongate members have grooves formed into peripheries thereof to increase a surface area of said peripheries and increase binding of said elongate members to said concrete encasement.

15. The foundation footing according to claim 14, wherein said binding chains are loosely secured to said elongate members prior to encasing said elongate members, and said binding chains are rigidly secured to said elongate members by means of said concrete encasement.

16. The foundation footing according to claim 15, wherein said binding chains are loosely secured to said elongate members by wrapping said binding chains about at least one side of said elongate members, twisting ends of said binding chains together, and securing said ends of said binding chains in fixed relation to respective ones of said elongate members by means of fasteners.

17. The foundation footing according to claim 16, further comprising holes formed into an upper surface of said elongate members for receiving connecting rods, and said connecting rods disposed within said holes for extending outward from said encasement in an upward direction.

18. The foundation footing according to claim 17, further comprising apertures formed into said elongate members for receiving ground pins, and said ground pins which extend from within said elongate members into the ground and preventing rotation of said elongate members.

* * * * *